US009790842B2

(12) United States Patent
Dudar et al.

(10) Patent No.: US 9,790,842 B2
(45) Date of Patent: Oct. 17, 2017

(54) COOLING SYSTEM DIAGNOSTIC METHOD

(71) Applicant: Ford Global Technologies, LLC, Dearborn, MI (US)

(72) Inventors: Aed M. Dudar, Canton, MI (US); Robert Roy Jentz, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 270 days.

(21) Appl. No.: 14/617,609

(22) Filed: Feb. 9, 2015

(65) Prior Publication Data

US 2016/0230644 A1 Aug. 11, 2016

(51) Int. Cl.
*F01P 11/18* (2006.01)
*F01P 11/16* (2006.01)

(52) U.S. Cl.
CPC ..... *F01P 11/18* (2013.01); *F01P 11/16* (2013.01)

(58) Field of Classification Search
CPC ..... F01P 11/18; F01P 11/16; F01P 11/14
See application file for complete search history.

(56) References Cited

U.S. PATENT DOCUMENTS

| | | | | |
|---|---|---|---|---|
| 5,735,249 | A | 4/1998 | Parke et al. | |
| 6,026,679 | A | 2/2000 | Holmes et al. | |
| 6,393,357 | B1 | 5/2002 | Holmes et al. | |
| 7,103,460 | B1 | 9/2006 | Breed | |
| 8,370,052 | B2 | 2/2013 | Lin et al. | |
| 2009/0260601 | A1 * | 10/2009 | Ulrey | F02B 1/12 123/512 |
| 2014/0297071 | A1 | 10/2014 | Dudar et al. | |

* cited by examiner

*Primary Examiner* — Kevin A Lathers
(74) *Attorney, Agent, or Firm* — Julia Voutyras; McCoy Russell LLP

(57) ABSTRACT

A method for operating an engine cooling system is provided. The method includes monitoring a coolant temperature profile after engine shut-down and indicating a low coolant level based on the coolant temperature profile determined after engine shut-down.

18 Claims, 6 Drawing Sheets

COOLING SYSTEM DIAGNOSTIC METHOD

FIELD

The present disclosure relates to a diagnostic method for an engine cooling system.

BACKGROUND AND SUMMARY

Vehicle engines employ cooling systems to remove excess heat generated during the combustion process, to increase engine efficiency and prevent engine overheating. Many cooling systems utilize liquid coolant as opposed to air cooling systems to remove greater amounts of heat from the engine due to the significantly higher thermal mass of coolant when compared to air. However, liquid cooling systems may experience leaks that can lead to engine overheating and component degradation.

Cooling system diagnostics have been developed to determine errors and failures in engine cooling systems. U.S. Pat. No. 8,370,052 discloses a cooling system diagnostic algorithm is implemented during start-up to determine if there is a cooling system error. However, leaks in the cooling system disclosed in U.S. Pat. No. 8,370,052 may go undetected for a number of reasons, such external environmental conditions as well as the size, location, and/or type of the coolant leak. For instance, smaller coolant leaks can be more difficult to detect and may be attributed to expected pressure fluctuations in the cooling system. Additionally, implementing the cooling system diagnostic algorithm only during engine start-up limits the timeframe during which cooling system errors can be detected, decreasing the likelihood of error determination.

The Inventors have discovered a novel strategy for implementing cooling systems diagnostics. As such in one approach a method for operating an engine cooling system is provided. The method includes monitoring a coolant temperature profile after engine shut-down and indicating a coolant level based on the coolant temperature profile determined after engine shut-down, for example the method may include indicating a low coolant level to an operator. In this way, coolant leaks can be detected during engine shut-down, expanding the timeframe over which leaks can be detected. As a result, the likelihood of engine overheating is reduced. Furthermore, using the coolant temperature profile after engine shut-down to determine cooling system errors enables smaller coolant leaks to be detected by the diagnostic routine when compared to previous diagnostic routines due to the predictable decay of the coolant temperature profile during shut-down. Consequently, cooling system diagnostics are improved when a coolant temperature decay profile is utilized. Additionally, determining coolant leaks during engine shut-down increases the likelihood of a vehicle operator recognizing the indication of the low coolant level and subsequently servicing the cooling system. In one example, the indication of the low coolant level may also be based on external environmental conditions, to further improve diagnostic accuracy.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED DESCRIPTION

A method for operating an engine cooling system is described herein. The method may include monitoring a coolant temperature profile after engine shut-down and indicating a low coolant level based on the coolant temperature profile. In one example, the coolant temperature profile may be compared to a predicted temperature profile to ascertain if the coolant level is low. It will be appreciated that the predicted coolant temperature profile can be accurately determined, prior to monitoring the coolant temperature profile, based on empirical data entered into a decay equation (e.g., exponential decay equation) modeling a coolant curve to determine a time constant in the equation. However, other techniques may be used to calculate the predicted coolant temperature profile. This comparison enables even small coolant system leaks to be reliably determined due to the accuracy of the decay equation. As a result, cooling system diagnostics are improved.

Figure 1:
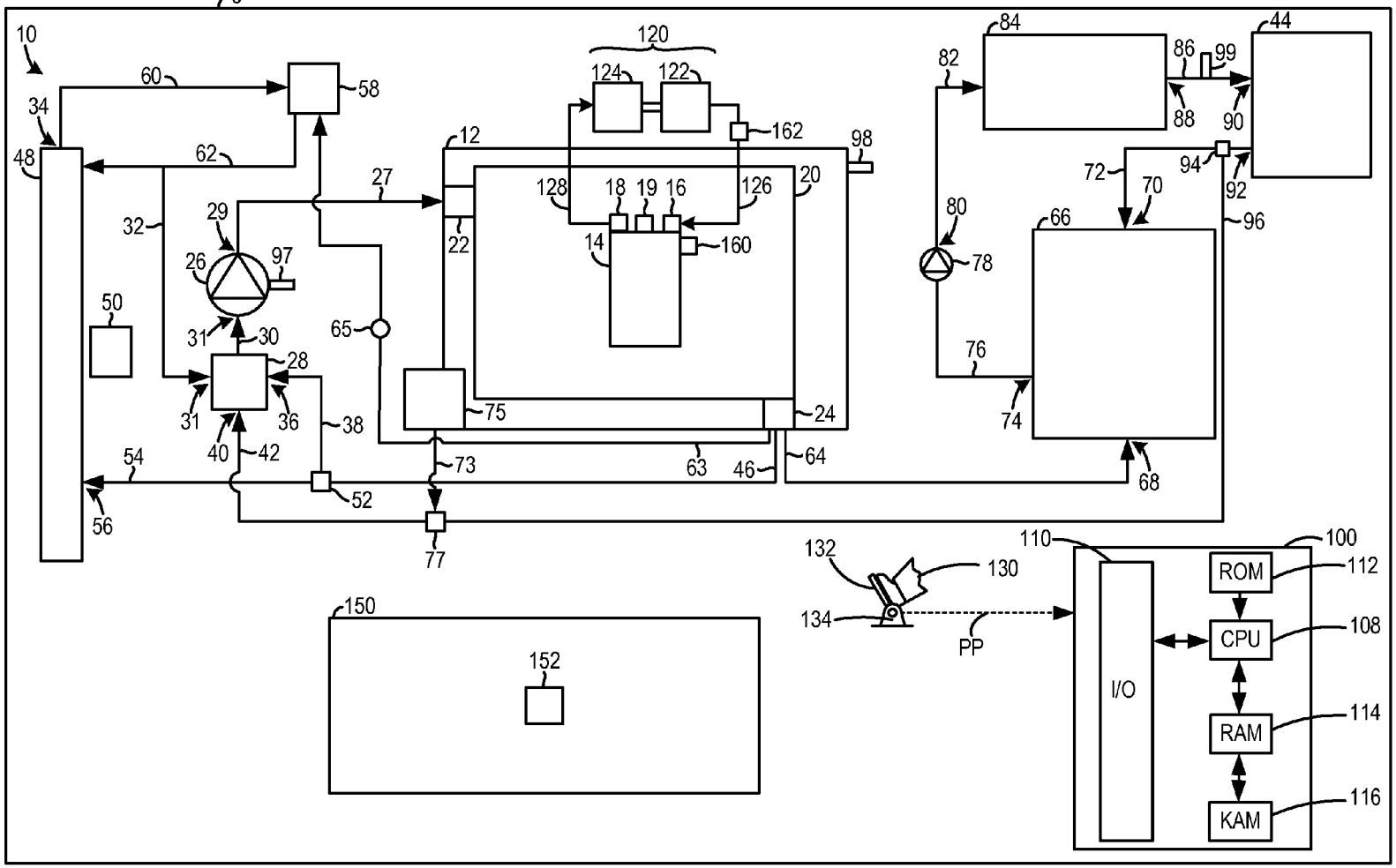
FIG. 1 shows a schematic depiction of an engine and engine cooling system.

FIG. 1 shows a schematic depiction of an engine cooling system 10. The engine cooling system 10 includes an engine 12 having a cylinder 14, the engine 12 included in a vehicle 5. However, engine with multiple combustion chambers or cylinders have been contemplated. Engine 110 may include a suitable type of engine including a gasoline or diesel engine. Each cylinder is configured to receive intake air and expel exhaust gas via at least one intake valve 16 and exhaust valve 18, respectively. An ignition device 19 may also be coupled to the cylinder 14. The ignition device 19 is configured to provide an ignition spark to the air/fuel mixture in the cylinder. However, in other examples the ignition device 19 may be omitted and the engine may be configured to implement compression ignition.

The engine 12 may include a turbocharger 120 including a compressor 122 coupled to a turbine 124. The compressor 122 is configured to provide boost to the cylinder 14 as indicated via arrow 126. A throttle 162 may be positioned in the intake line 126 coupling the compressor to the intake valve 16. The throttle 162 is configured to adjust the amount of intake air flowing to the cylinder 14. Additionally, the turbine 124 receives exhaust gas from the cylinder 14, as indicated via arrow 128. The turbine 124 is configured to drive the compressor 122 from energy extracted from the exhaust gas flowing therethrough. In other examples, the compressor 122 may be driven via rotational output of a crankshaft and therefore may be included in a supercharger.

A plurality of coolant passages (not shown) traversing the engine are included in a cooling circuit 20 in the cooling system 10. The cooling passages may be included in cylinder head and/or cylinder block cooling jacket, in one example. Thus, the cooling passages may traverse a cylinder head and/or cylinder block.

Coolant is introduced into the engine 12 via a coolant inlet 22. As discussed above, the coolant can circulate through coolant passages in the engine 12 to extract heat therefrom. Additionally, coolant is removed from the engine 12 via a coolant outlet 24. In other examples, the cooling system may include two or more coolant inlets and/or coolant outlets.

The cooling system 10 includes a first pump 26 configured to circulate coolant through the cooling system 10. In the depicted example, the first pump 26 is positioned directly upstream of the coolant inlet 22. However, other locations of the first pump 26 in the cooling system 10 have been contemplated. A coolant line 27 is coupled to an outlet 29 of the first pump 26 and the coolant inlet 22.

A thermostat 28 is also included in the cooling system 10. The thermostat 28 is configured to adjust the flow of coolant therethrough based on the temperature of the coolant. Thus, conceptually the thermostat has the functionality of a temperature sensor and a valve. In the depicted example, the thermostat 28 is positioned directly upstream of the first pump 26. However, other locations of the thermostat in the cooling system have been contemplated. As shown, the output of the thermostat 28 is coupled to a coolant line 30 coupled to an inlet 31 of the first pump 26. Additionally, the thermostat 28 includes a first inlet 31 receiving coolant from a coolant line 32 coupled to heat exchanger outlet 34 of a heat exchanger 48 and a second inlet 36 receiving coolant from a first heat exchanger bypass line 38 coupled to the coolant outlet 24 of the engine 12. The thermostat 28 includes a third inlet 40 receiving coolant from a coolant line 42 coupled to a second heat exchanger 44 (e.g., heater core, cabin heater), discussed in greater detail herein. A coolant line 46 is provided in the cooling system 10 to couple the coolant outlet 24 of the engine 12 to the first heat exchanger 48 (e.g., radiator). The first heat exchanger 48 is configured to remove heat from the coolant flowing therethrough. As shown, a fan 50 (e.g., heat exchanger fan) may be provided in the cooling system 10 which adjusts the amount of airflow directed at the first heat exchanger 48 to enable an increase or decrease in heat transfer from the coolant flowing through the first heat exchanger 48 to the surrounding air.

A heat exchanger bypass valve 52 is also included in the cooling system 10. The heat exchanger bypass valve 52 is configured to adjust (e.g., increase/decrease and permit/inhibit) the amount of coolant flow through the heat exchanger bypass line 38. Thus, the heat exchanger bypass valve 52 can control the amount of coolant flowed to the first heat exchanger 48.

A coolant line 54 is coupled to the heat exchanger bypass valve 52 and an inlet 56 of the first heat exchanger 48. The coolant line 54 enables coolant to be flowed to the heat exchanger to enable heat removal from the coolant. The cooling system 10 further includes a de-gas tank 58. The de-gas tank 58 is configured to remove gas from the coolant flowing therethrough. A coolant line 60 is coupled to the de-gas tank 58 and the outlet 34 of the first heat exchanger 48. Another coolant line 62 is coupled to the de-gas tank 58 and the coolant line 32. It will be appreciated that coolant flows through the lines 32, 60, and 62. A de-gas line 63 is coupled to the coolant outlet 24 of the engine 12 and the de-gas tank 58. A check valve 65 is coupled to the de-gas line 63. The check valve 63 is configured to open when the pressure in the de-gas line exceeds a threshold value. In this way, gas can be removed from the coolant outlet 24.

A coolant line 64 coupled to the coolant outlet 24 of the engine flows coolant to a valve 66. Specifically, the coolant line 64 flows coolant into a first inlet 68 of the valve 66. Additionally, the valve 66 includes a second inlet 70 receiving coolant from a coolant line 72 coupled to the second heat exchanger 44.

The valve 66 includes an outlet 74 coupled to a coolant line 76 providing coolant to a second pump 78 (e.g., auxiliary pump). The second pump 78 is configured to provide coolant flow through the cooling system 10. The second pump 78 includes an outlet 80 coupled to a coolant line 82 coupled to an electric heater 84. The electric heater 84 is configured to increase the temperature of the coolant flowing therethrough. It will be appreciated that the electric heater 84 may be operated during warm-up and/or during shut-down. In this way, warm coolant can be provided to the second heat exchanger 44 during a cold start. A coolant line 86 is coupled to an outlet 88 of the electric heater 84 and an inlet 90 of the second heater exchanger 44. The second heat exchanger 44 may be a cabin heat exchanger configured to provide heat to a cabin 150 in the vehicle 5. The second heat exchanger 44 includes an outlet 92. A valve 94 is coupled to the coolant line 72. The valve 94 is configured to adjust (e.g., increase/decrease, permit/inhibit, etc.,) coolant flow into the coolant line 72 and into a coolant line 96 flowing coolant to the third inlet 40 of the thermostat 28. A coolant line 73 coupled to an exhaust gas recirculation (EGR) valve 75. Thus, the coolant line 73 may receive coolant flowed through or adjacent to the EGR valve 75. The EGR valve 75 may be configured to adjust the amount of EGR flow in the engine. The coolant line 73 is coupled to a valve 77 configured to adjust the amount of coolant flowed from the coolant line 73 into the coolant line 96.

A temperature sensor 98 is coupled to the engine 12. A temperature sensor 99 is also coupled to the coolant line 86. Additionally, a temperature sensor 97 may be coupled to the first pump 26. It will be appreciated that in other examples only one of the temperature sensors (97, 98, and 99) may be included in the cooling system 10. The temperature sensors (97, 98, and 99) are configured to send signals to an electronic controller 100. From these signals the controller 100 is configured to determine a coolant temperature profile. Thus, the coolant temperature profile can be determined from the temperature sensor signals. The cooling system 10 further includes the controller 100. Various actuators and additional sensors are coupled to the controller 100. Specifically, the controller 100 is configured to control the ignition device 19, first pump 26, the second pump 78, the fan 50, the valve 52, the valve 66, the valve 94, the EGR valve 75, the valve 77, fuel injector 160, throttle 162, and/or the turbocharger 122. Therefore, the controller can adjust the output of the aforementioned pumps and fan as well as the flow through the aforementioned valves.

The controller 100, in this particular example, includes an electronic control unit comprising one or more of an input/output device 110, a central processing unit (CPU) 108, read-only memory (ROM) 112, random-accessible memory (RAM) 114, and keep-alive memory (KAM) 116. Engine controller 100 may receive various signals from sensors coupled to engine 10, including measurement of inducted mass air flow (MAF) from mass air flow sensor (not shown); engine temperature sensor 98; exhaust gas air/fuel ratio from exhaust gas sensor (not shown); operator input device 132 actuated via an operator 130, pedal position sensor 134; etc. Furthermore, engine controller 100 may monitor and adjust the position of various actuators based on input received from the various sensors. These actuators may include, for example, a throttle (not shown), intake valve 16, exhaust valve 18, ignition device 19, the first pump 26, the fan 50, the second pump 78, the valve 52, the valve 66, the valve 94, the EGR valve 75, the valve 77, the turbocharger 122 (e.g., the compressor 122 and the turbine 124), fuel injector 160, throttle 162, etc. Storage medium read-only memory 112 can be programmed with computer readable data representing instructions executable by processor 108 for performing the methods described below, as well as other variants that are anticipated but not specifically listed thereof.

The engine cooling system 10 further includes a low coolant level indicator 152 positioned within the cabin 150. The coolant level indicator 152 may include at least one of a visual indicator (e.g., a light, graphics presented on a display, etc.,) and an audio indicator (e.g., speaker). In this way, the vehicle operator can be alerted of cooling system errors.

In one example the controller 100 may be configured to determine a plurality of predicted coolant curves. For instance, empirical data may be gathered at different ambient temperatures, where the initial engine coolant temperature is held constant for each set of empirical coolant curve data that is gathered. For instance, the initial engine coolant temperature may be 200° F. and the temperature decay values at particular time intervals may be gathered at different ambient temperature (e.g., 40° F., 60° F., 80° F., and 100° F.). Thus, the empirical data may include a plurality of coolant temperatures at different time values. It will be appreciated that this empirical data may be collected when the cooling system is functioning as desired and has a coolant level above a threshold value. The empirical data may be entered into an exponential decay equation to determine the predicted cooling profiles and particularly a time constant for the exponential decay equation. In one example, the following exponential decay equation may be used to determine the time constants.

$$\text{ECT Decay}=a*e^{(t/te)} \quad (1)$$

where a=(ECT−AAT) at key off
ECT: engine coolant temperature
AAT: ambient air temperature
tc: time constant Time constants may be determined for different ambient temperatures after the empirical data is gathered. The time constants can be determined by entering the empirical data into the exponential decay equation. For instance, time constants at 40° F., 60° F., 80° F., and 100° F. may be determined using the exponential decay equation after the empirical data is entered into the equation. Thus, it will be appreciated that the time constants may be regressed and stored in the controller 100 (e.g., powertrain control module {PCM}). The stored cooling curves can predict when the ECT=AAT. For instance, if the ambient temperature is 80° F. and the initial ECT=200° F. at key-off, the cooling curve may predict in 7 hours the ECT will equal AAT when the cooling system has not experienced coolant loss. However, when the cooling system experiences coolant leaks the ECT decay will be much smaller. Therefore, a unique ECT decay threshold which indicates a loss of coolant in the cooling system may be determined. The ECT decay threshold may be expressed in terms of ECT and a time value.

The controller 100 may further be configured to receive power after engine shut-down (e.g., key-off) to enable a cooling system diagnostic routine to be implemented. The controller 100 may also be configured to determine a coolant temperature. In one example, the coolant temperature profile includes two or more coolant values at different time values. Furthermore, the coolant temperature profile may be determined from signals from one or more temperature sensors in the engine, such as the temperature sensor 98 that is coupled to the engine 12 and/or another temperature sensor which is submerged in coolant. When the temperature sensor 98 is used the engine coolant temperature can be inferred from the temperature sensor signal. Additionally, the controller 100 may be configured to indicate a low coolant level based on the coolant temperature profile determined after engine shut-down. For instance, the coolant temperature profile may be compared to a predicted coolant temperature profile to determine when the low coolant level is indicated. It will be appreciated that the predicted coolant temperature profile may be determined from the time constants stored in the controller. However, other ways of storing the predicted coolant temperature profile has been contemplated. In one example, the predicted coolant temperature profile is included in a set of predicted coolant temperature profiles that are predetermined and stored in memory in the controller, as discussed above.

Further in one example, the controller is configured to receive power after engine shut-down and determine the coolant temperature profile in response to one of an engine shut-down event and a cabin heat exchanger coupled to the cooling circuit generating heat less than a threshold value. In this way, an engine shut-down event or a decrease in cabin heating output can be used to trigger a diagnostic routine. Yet further in one example, indicating the low coolant level may include generating a diagnostic trouble code (e.g., unique diagnostic trouble code). Further in one example, one or more of the following actions may be implemented in response to indicating the low coolant level; reducing engine power output during a subsequent engine start-up, inhibiting engine operation until a low coolant level is not indicated, limiting boost provided to the engine by a compressor during a subsequent engine start-up, decreasing airflow to the engine during a subsequent engine start-up, limiting engine fuel injection, and inhibiting of spark retard during a subsequent engine start-up. Still further in other examples, two or more of the aforementioned actions may be implemented in response to indicating a low coolant level. For instance, boost to the engine may be limited and spark retard may be inhibited during a subsequent engine start-up. Furthermore, the actions may be implemented at overlapping time intervals in one example and at non-overlapping time intervals in other examples. It will be appreciated that these actions may be coordinated to reduce the likelihood of engine overheating (e.g., maintain the engine temperature below a threshold value). For instance, engine airflow may be reduced by an amount which is proportional to a fuel injection decrease. In this way, engine operation can be improved and engine longevity can be increased.

It will be appreciated that the engine 12 can also include a fuel delivery system configured to provide fuel to the cylinder 14. For instance, a direct fuel injector 160 is coupled to the cylinder 14 and configured to provide metered fuel to the cylinder. Additionally, intake and exhaust system may be provided to flow intake air into the engine cylinder and receive exhaust gas from the engine cylinder, respectively.

Figure 2:
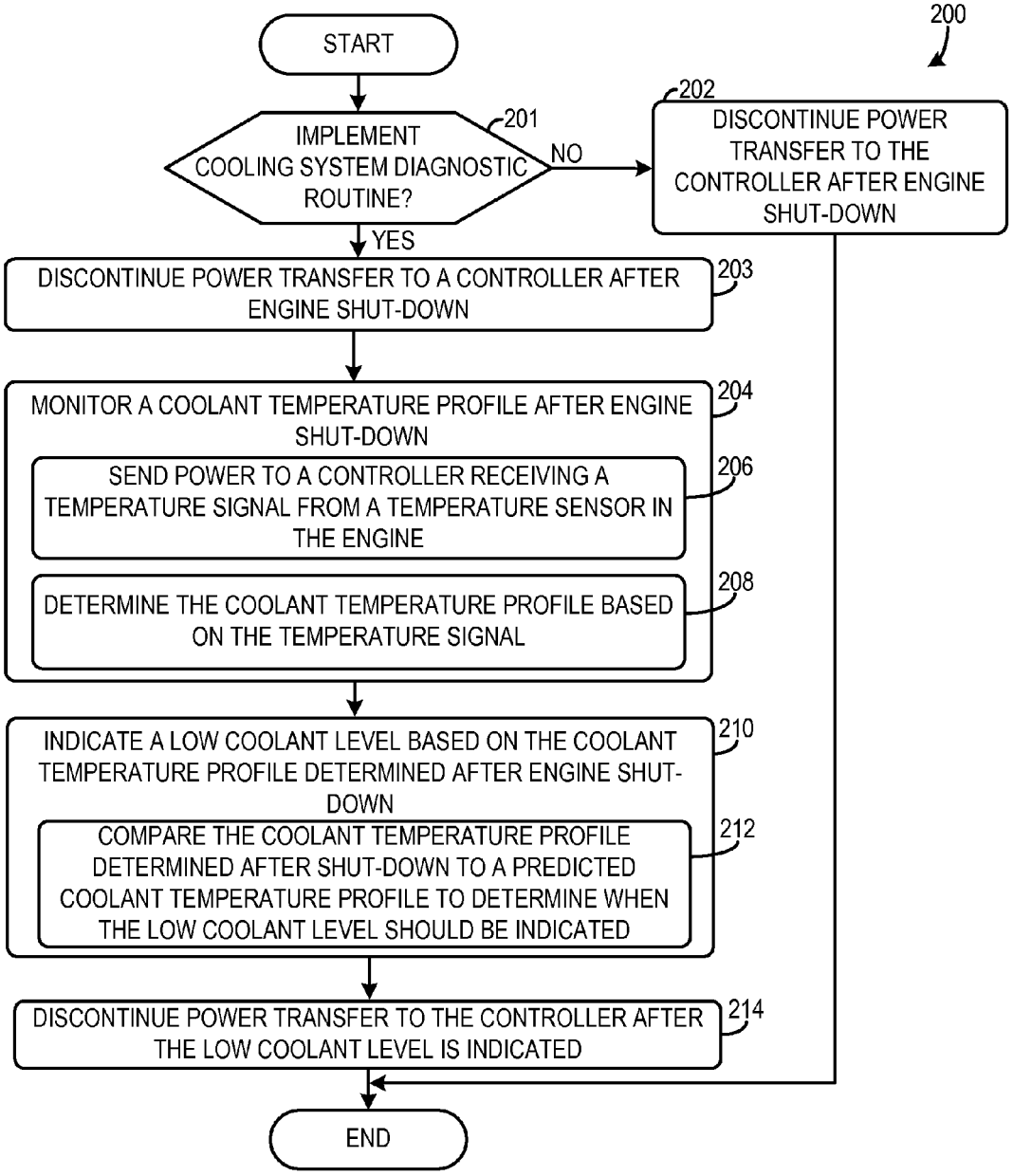
FIG. 2 shows a method for operating an engine cooling system.

FIG. 2 shows a method 200 for operating an engine cooling system. The method 200 may be implemented by the engine cooling system 10 described above with regard to FIG. 1 or may be implemented by another suitable engine cooling system.

At 201 the method determines if a cooling system diagnostic routine should be implemented. It will be appreciated that an engine shut-down event (e.g., key-off) may be used to trigger implementation of the diagnostic routine. Additionally or alternatively, cabin heater output may be used to trigger implementation of the diagnostic routine. For instance, when the cabin heater output is less than a threshold value, the cooling system diagnostic routine may be implemented.

If it is determined that the cooling system diagnostic routine should not be implemented (NO at 201) the method advances to 202. At 202 the method includes discontinuing power transfer to the controller after engine shut-down. In other examples step 202 may be omitted from the method.

However, if it is determined that the cooling system diagnostic routine should be implemented (YES at 201) the method advances to 203. Additionally, it will be appreciated that the diagnostic routine may be discontinued (e.g., aborted) when there is a request for engine restart, in one example.

At 203, the method includes discontinuing power transfer to a controller after engine shut-down. Discontinuing power transfer to the controller can reduce energy usage during shut-down. However, in other examples step 203 may be omitted from the method 200. Next at 204 the method includes monitoring a coolant temperature profile after engine shut-down. Monitoring the coolant temperature profile after engine shut-down may include steps 206-208. At 206 the method includes sending power to a controller receiving a temperature signal from a temperature sensor in the engine. In this way, the controller is powered up after engine shut-down and after power transfer to the controller is discontinued after engine shut-down. In this way, the controller can be power during selected engine shut-down periods. However, in other examples discontinuing power transfer to the controller may be inhibited when it is determined that the cooling system diagnostic routine should be implemented. At 208 the method includes determining the coolant temperature profile based on the temperature signal. In this way, the current coolant temperature profile may be determined based on a temperature sensor signal in the engine.

After 204, the method advances to 210. At 210 the method includes indicating a low coolant level based on the coolant temperature profile determined after engine shut-down. In one example, environmental conditions may be used to determine if a low coolant level should be indicated.

Indicating the low coolant level based on the coolant temperature profile may include step 212. At 212 the method includes comparing the coolant temperature profile determined after engine shut-down to a predicted coolant temperature profile to determine when the low coolant level should be indicated. For example, if the coolant temperature profile determined after engine shut-down deviates from the predicted coolant temperature profile by a threshold value the low coolant level may be indicated. It will be appreciated that such a threshold deviation can imply a leak in the cooling system. Additionally, it will be appreciated that the predicted coolant temperature profiles may be stored and retrieved via a look-up table in the controller. Indicating a low coolant level in this way improves cooling system diagnostics by increasing the timeframe over which cooling system diagnostics can be implemented. Next at 214 the method includes discontinuing power transfer to the controller after the low coolant level is indicated. However, in other examples step 214 may be omitted from the method.

Figure 3:
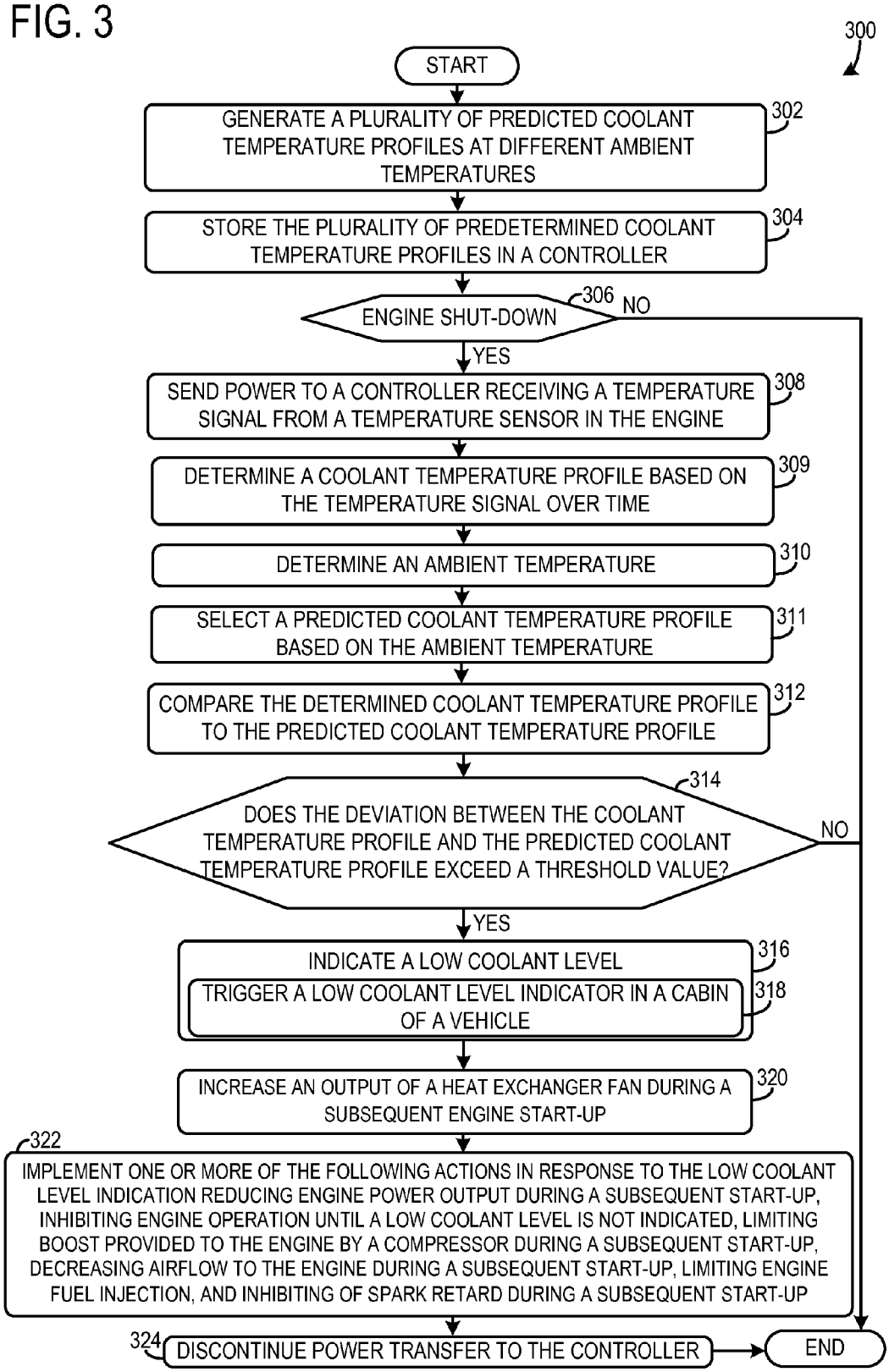
FIG. 3 shows another method for operating an engine cooling system.

FIG. 3 shows a method 300 for operating an engine cooling system. The method 300 may be implemented via the engine cooling system 10 described above with regard to FIG. 1 or may be implemented by another suitable engine cooling system.

At 302 the method includes generating a plurality of predicted coolant temperature profiles at different ambient temperatures. Thus, a different coolant temperature profile may be determined for each ambient temperature. Specifically, the cooling profiles for an engine operating at a predetermined initial engine coolant temperature (ECT) (e.g., 200° F.) can be collected at various ambient temperatures (e.g., 40° F., 60° F., 80° F. and 100° F.), in one example. The predicted coolant temperature profiles may be determined based on an exponential decay (e.g., an exponential decay equation) and empirical data gathered at the different ambient temperatures. The exponential decay equation for the ECT to cool down to ambient (AAT) may be the previously discussed exponential decay equation. It will be appreciated that the empirically gathered data is collected while the coolant level in the cooling system is above a threshold value and the cooling system is functioning as desired.

Next at 304 the method includes storing the plurality of predicted coolant temperature profiles in a controller. Additionally, it will be appreciated that the predicted coolant temperature profiles may be stored in a look-up table as a set of profiles. However, other suitable techniques for storing the predicted coolant temperature profiles have been contemplated.

At 306 it is determined if an engine shut-down event has occurred. Additionally, step 306 may include determining if there is a vehicle off condition. It will be appreciated that an engine shut-down event includes an engine event where engine combustion is discontinued and the engine is not performing combustion cycles and the engine is maintained at rest. If an engine shut-down event has not occurred (NO at 306) the method ends. Additionally, it will be appreciated that the diagnostic routine implemented during engine shut-down may be discontinued (e.g., aborted) when there is a request for engine restart.

However, if an engine shut-down event has occurred (YES at 306) the method advances to 308. At 308 the method includes sending power to a controller receiving a temperature signal from a temperature sensor in the engine. Next at 309 the method includes determining a coolant temperature profile based on the temperature signal over time. In one example, the coolant temperature profile is determined in direct response to an engine shut-down event. Next at 310 the method includes determining an ambient temperature. At 311 the method includes selecting a predicted coolant temperature profile based on the ambient temperature. In one example, the predicted coolant temperature profile may be dynamically selected based on the ambient temperature while the current coolant temperature profile is determined. For instance, a predicted coolant curve with a larger ambient temperature may be selected if the ambient temperature increases while the current coolant temperature profile is determined. On the other hand, a predicted coolant curve with a smaller ambient temperature may be selected if the ambient temperature decreases while the current coolant temperature profile is determined. Additionally in one example, the predicted coolant temperature profile may be adjusted based on other environmental conditions such as wind speed, humidity, rainfall, etc. For instance, a different predicted profile may be used when the external humidity exceeds a threshold value.

Next at 312 the method includes comparing the determined coolant temperature profile to the predicted coolant temperature profile included in the plurality of predicted coolant temperature profiles generated at step 302. It will be appreciated that comparing the coolant temperature profile to the predicted coolant temperature profile is implemented during engine shut-down.

At 314 the method includes determining if the deviation between the coolant temperature profile and the predicted coolant temperature profile exceed a threshold value. The threshold value may be determined based on. Additionally in one example, comparing the coolant temperature profile to the predicted coolant temperature profile includes determining differences between a plurality of coolant temperatures in each profile and summing the temperature differences to determine if the profile deviation is greater than the threshold value. In other words, delta temperature values can be determined at numerous time instances and the errors can be accumulated over time to determine a total error of the measured temperature profile after a threshold duration to determine when there is a low coolant level in the cooling system. In other examples, only two temperatures at the same time interval may be compared to determine deviation between the profiles. The time interval may be selected based on environmental conditions as well as other factors, in one example.

If the deviation between the coolant temperature profile and the predicted coolant temperature profile does not exceed the threshold value (NO at 314) the method ends. However, if the deviation between the coolant temperature profile and the predicted coolant temperature profile exceeds the threshold value (YES at 314) the method advances to 316. At 316 the method includes indicating a low coolant level. Indicating a low coolant level may include at 318 triggering a low coolant level indicator in a cabin of a vehicle. The low coolant level indicator may include one or more of a visual indicator and an audio indicator. In this way, a vehicle operator may be alerted of cooling system errors, enabling the operator to take steps to remedy the problem. Next at 320 the method may include increasing an output of a heat exchanger fan during a subsequent engine start-up. In this way, the likelihood of engine overheating is reduced, thereby increasing engine longevity. At 322 the method includes implementing one or more of the following actions in response to the low coolant level; indication reducing engine power output during a subsequent start-up, inhibiting engine operation until a low coolant level is not indicated, limiting boost provided to the engine by a compressor during a subsequent start-up, decreasing airflow to the engine during a subsequent start-up, limiting engine fuel injection, and inhibiting of spark retard during a subsequent start-up. In this way, various actions can be implemented to reduce the likelihood of engine overheating when a low coolant level in the cooling system is present. Next at 324 the method includes discontinuing power transfer to the controller. Thus in one example, the power transfer to the controller may be discontinued after the low coolant level is indicated. Specifically in one example, the power transfer to the controller can be discontinued in response to implementing one or more of the actions in 322. It will be appreciated that steps 320-324 may be implemented in response to indicating the low coolant level.

Figure 4:
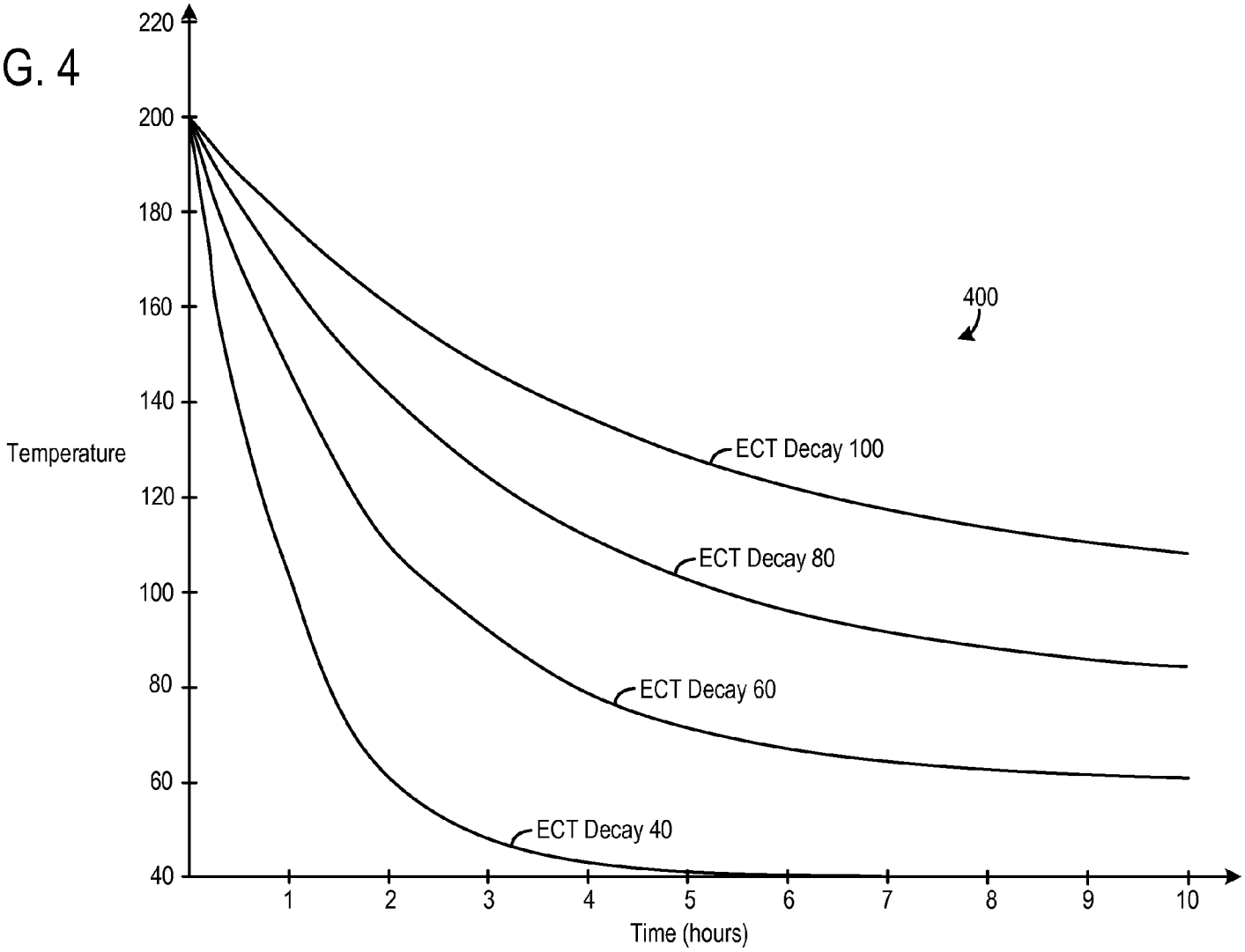
FIGS. 4-6 show graphs depicting various coolant temperature profiles of coolant in an engine cooling system.
Figure 5:
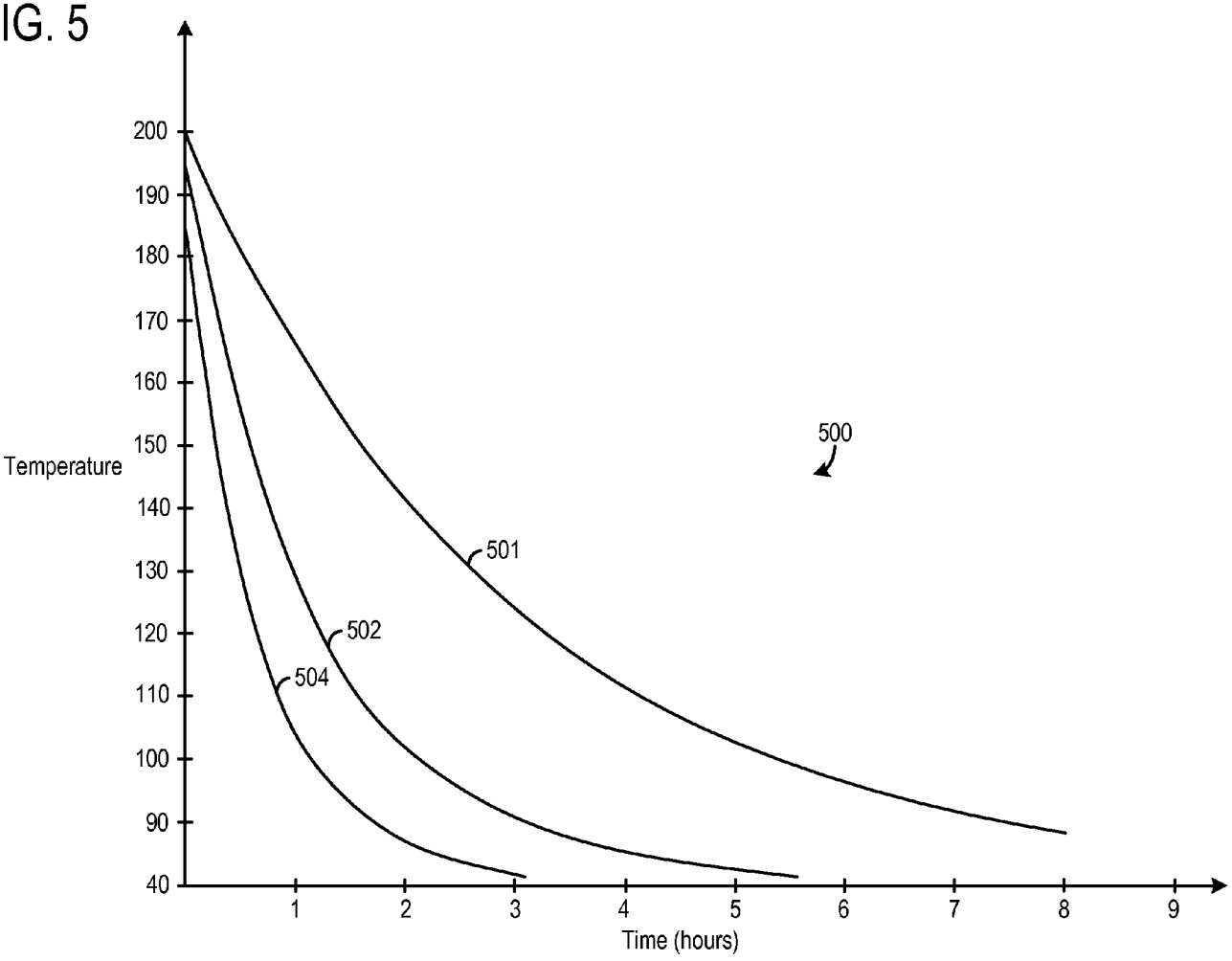
Figure 6:
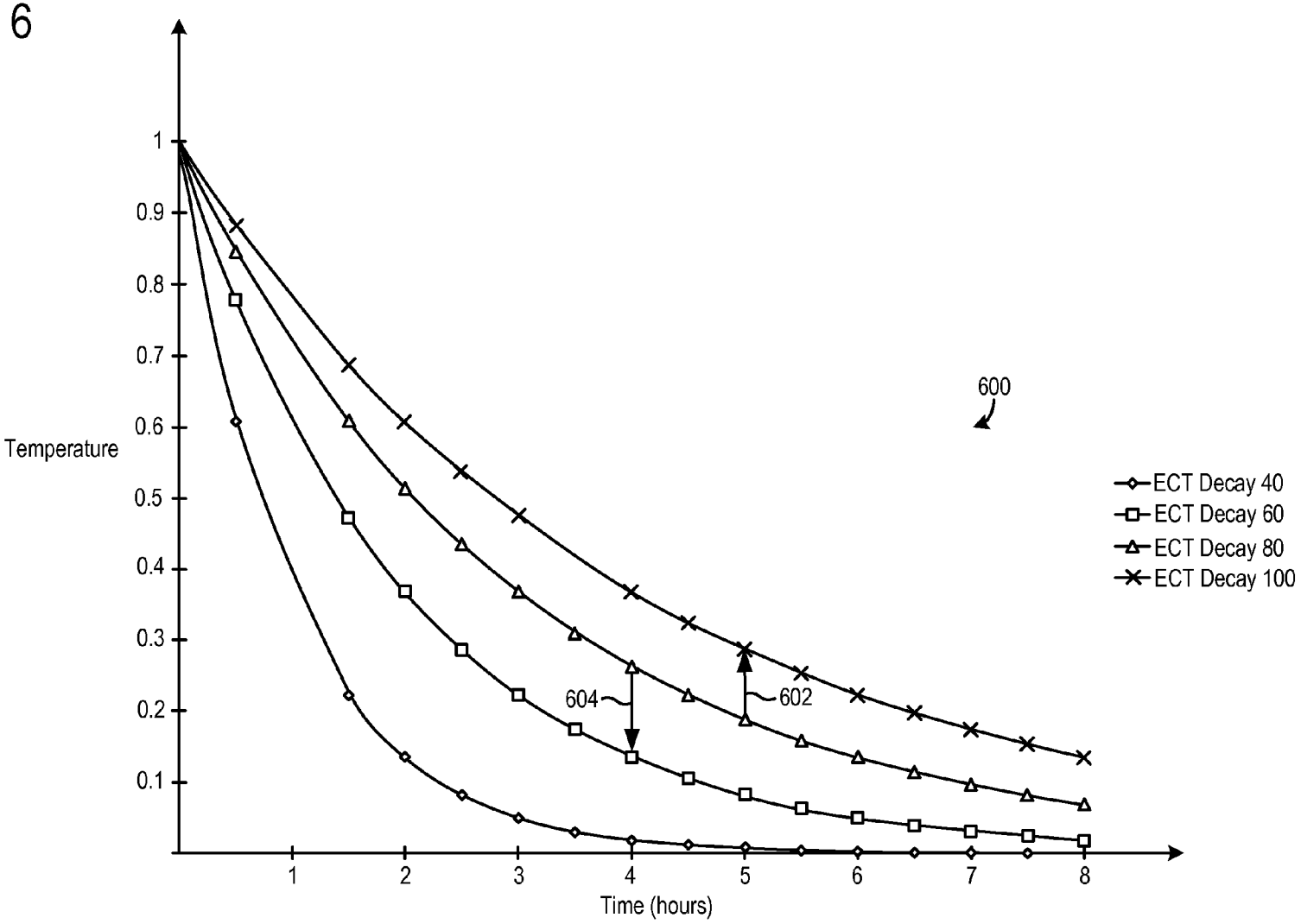

FIGS. 4-6 show graphs depicting different coolant temperature profiles after an engine shut-down event has occurred. Specifically, FIG. 4 shows a graph 400 of a plurality of coolant temperature profiles (e.g., cooling curves) which are empirically collected. For instance, the cooling curves shown in FIG. 4 may be generated at step 302 in FIG. 3. Continuing with FIG. 4, the coolant curve gathered at the following ambient temperature: 40° F., 60° F., 80° F., and 100° F. As shown, the initial ECT for each cooling curve is 200° F. However, other initial ECT temperatures have been contemplated.

FIG. 5 shows a graph 500 depicting a plurality of coolant temperature profiles (e.g., temperature decay curves) 501, 502, and 504. The coolant temperature profile at 501 shows an expected coolant temperature profile after engine shut-down when the ambient temperature is 80° F. and the coolant level in the engine is above a threshold value.

The coolant temperature profile 502 shows a coolant temperature profile after engine shut-down where the cooling system has partial coolant loss. Thus, the coolant level in the cooling system is less than a desirable value. Additionally, the coolant temperature profile 504 shows a coolant temperature profile after engine shut-down where the cooling system has total coolant loss. Thus, the coolant temperature profiles 502 and 504 show varying levels of coolant loss in the coolant system. As shown, the profiles 502 and 504 deviate from the expected coolant temperature profile 500. Specifically, the ECT reaches AAT much more quickly in the profiles 502 and 504 when comparted to the profile to due to the greater amount of engine coolant in the cooling system. Therefore, it will be appreciated that this deviation indicates a low coolant level and therefore a coolant leak in the cooling system. As previously discussed, a low coolant level may be indicated based on this deviation.

FIG. 6 shows a graph 600 depicting how different predicted coolant temperature profiles may be selected during engine shut-down to determine a low coolant level indication. Specifically, different predetermined coolant temperature profiles may be selected when the ambient temperature around the cooling system changes during an engine shut-down period where the current coolant temperature profile is determined for a comparison with a predicted coolant temperature profile. The graph in FIG. 6 shows a plurality of coolant temperature profiles (e.g., cooling curves) which are empirically collected. As shown, initially the predicted coolant temperature profile where the ambient temperature is 80° F. is selected. However, if the ambient temperature changes during engine shut-down a different predicted coolant temperature profile. For instance, arrow 602 indicates the selection of a higher ambient temperature predicted coolant temperature profile when the ambient temperature increases and arrow 604 indicates the selection of a lower ambient temperature predicted coolant temperature profile when the ambient temperature decreases during engine shut-down. In this way, the accuracy of the diagnostic routine is increased.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. As another example, the coolant level monitoring after engine shutdown may be in addition to coolant level monitoring techniques that are carried out and/or based on information during engine running and combusting conditions, such as engine coolant temperature measurements, knock feedback, and/or combinations thereof. In addition, the coolant temperature profile may include sampled coolant temperature at a multitude of sample times determined based on an expected exponential decay of coolant temperature toward ambient temperature. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine cooling system comprising:

after an engine shut-down, sending power to a controller;

at the controller, receiving a temperature signal from an engine temperature sensor and determining a coolant temperature profile based on the temperature signal; and adjusting engine power output during a subsequent engine start-up based on the coolant temperature profile determined after engine shut-down.

2. The method of claim 1, wherein adjusting engine power output during the subsequent engine start-up comprises one or more of reducing engine power output during the subsequent start-up, inhibiting engine operation until coolant temperature is above a threshold, limiting boost provided to the engine by a compressor during the subsequent start-up, decreasing airflow to the engine during the subsequent start-up, limiting engine fuel injection, and inhibiting of spark retard during the subsequent start-up.

3. The method of claim 1, further comprising discontinuing power transfer to the controller before sending power to the controller and determining the coolant temperature profile.

4. The method of claim 1, wherein the determination of the coolant temperature profile is also based on environmental conditions.

5. The method of claim 1, where the coolant temperature profile is compared to a predicted coolant temperature profile to determine whether a coolant level is lower than a threshold.

6. The method of claim 5, where the predicted coolant temperature profile is generated based on an exponential decay.

7. The method of claim 1, further comprising, at the controller, during engine combustion operation, determining a coolant level based on the temperature signal from the temperature sensor in the engine.

8. The method of claim 1, where determining the coolant temperature profile is initiated in response to a climate control unit generating heat less than a threshold value.

9. The method of claim 1, further comprising, triggering a low coolant level indicator in a cabin of a vehicle based on the coolant temperature profile determined after engine shut-down.

10. The method of claim 9, further comprising increasing an output of a heat exchanger fan during the subsequent engine start-up in response to triggering of the low coolant level indicator.

11. An engine cooling system comprising:

a cooling circuit circulating coolant through passages traversing an engine;

a heat exchanger coupled to the cooling circuit;

a temperature sensor coupled to at least one of the cooling circuit and the engine; and a controller configured to:

after engine shut-down, receive power;

determine a coolant temperature profile based on a signal sent from the temperature sensor; and adjust engine power output during a subsequent start-up based on the coolant temperature profile determined after engine shut-down.

12. The engine cooling system of claim 11, where the coolant temperature profile is compared to a predicted coolant temperature profile to determine how to adjust engine power during the subsequent start-up.

13. The engine cooling system of claim 12, where the predicted coolant temperature profile is included in a set of predicted coolant temperature profiles that are predicted and stored in memory in the controller.

14. The engine cooling system of claim 11, where the controller is configured to receive power after engine shut-down and determine the coolant temperature profile in response to one of an engine shut-down event and a cabin heat exchanger coupled to the cooling circuit generating heat less than a threshold value.

15. A method for operating an engine cooling system comprising:

after engine shut-down and vehicle off condition, maintaining power to a controller that determines a coolant temperature profile over time;

comparing the coolant temperature profile to a predicted coolant temperature profile; and if a deviation between the determined coolant temperature profile and the predicted coolant temperature profile exceeds a threshold value, triggering a low coolant level indicator in a vehicle cabin based on the coolant temperature profile determined after engine shut-down.

16. The method of claim 15, where comparing the coolant temperature profile to the predicted coolant temperature profile includes determining differences between a plurality of coolant temperatures in each profile and summing the temperature differences to determine if the profile deviation is greater than the threshold value.

17. The method of claim 15, where the coolant temperature profile is determined in direct response to an engine shut-down event and comparing the coolant temperature profile to the predicted coolant temperature profile is implemented during engine shut-down.

18. The method of claim 15, further comprising after engine shut-down and before determining the coolant temperature profile, sending power to the controller and inhibiting power transfer to the controller after triggering the low coolant level indicator.

* * * * *